US005549484A

United States Patent [19]

Chen

[11] Patent Number: 5,549,484

[45] Date of Patent: Aug. 27, 1996

[54] ELECTRIC TERMINAL DEVICE

[75] Inventor: Chih-Chinh Chen, Chung Ho, Taiwan

[73] Assignee: Eric-Cambridge Co., Ltd., Taipei Hsien, Taiwan

[21] Appl. No.: 368,338

[22] Filed: Jan. 4, 1995

[51] Int. Cl.[6] ..... H01R 4/24

[52] U.S. Cl. ..... 439/417; 439/404

[58] Field of Search ..... 439/404, 409, 439/417–419

[56] References Cited

U.S. PATENT DOCUMENTS

| | | | |
|---|---|---|---|
| 5,240,432 | 8/1993 | Daoud | 439/417 |
| 5,295,857 | 3/1994 | Toly | 439/417 |
| 5,302,137 | 4/1994 | Suffi | 439/417 |
| 5,474,467 | 12/1995 | Chen | 439/417 |

*Primary Examiner*—David L. Pirlot
*Attorney, Agent, or Firm*—Alfred Lei

[57] ABSTRACT

An electric terminal device including a cap having two opposite wire holes and two opposite side openings at the four sides and two downward flanges on the inside, and a connecting terminal having horizontal ribs raised from the front and back sides and respectively engaged with the side openings on the cap and two elongated cutting slots and two connecting legs for welding to a circuit board, wherein when the cap is fastened to the connecting terminal after the electric wire is inserted through the wire holes, the downward flanges force the electric wires into the cutting slots of the connecting terminal, causing the connecting terminal to make an electric contact with the electric wire.

1 Claim, 7 Drawing Sheets

ELECTRIC TERMINAL DEVICE

BACKGROUND OF THE INVENTION

The present invention relates to electric terminal devices, and relates more particularly to an electric terminal device which is easy to install and, which provides a stable electric contact when installed.

Various electric terminal devices are well known and intensively used in electric and electronic apparatus for connection between parts. While designing an electric terminal device there are certain requirements must be achieved. These requirements include (1) easy to assemble without the use of any hand tools; (2) easy to install; (3) stable and durable in use.

FIGS. 1A and 1B show an electric terminal device according to the prior art which is generally comprised of a cap A, a receptacle B, and a connecting metal frame C. The cap A comprises two spaced press flanges A2 and two opposite retaining recesses A1. The receptacle B comprises two opposite raised portions B1, which are respectively forced into the retaining recesses A1 when the cap A is covered on the receptacle B. The connecting metal frame C is fastened to the receptacle B, having a protruding leg D extended out of the receptacle B for welding to a circuit board.

The aforesaid electric terminal device is one portion of a bar of electric terminals (see FIGS. 2A and 2B). During the installation process, the electric wires E are respectively inserted into the gaps between each two adjacent receptacles B, then the caps A are fastened to the receptacles B to press the press flanges A2 against the electric wires E, causing the connecting metal frames C to pierce the insulators E1 of the electric wires E and to make a respective electric contact. Because several electric wires E are simultaneously installed, fixtures or like means must be used to hold the caps A and the receptacles B and to fasten them together. If the electric wires E are individually installed one after another, a pointed hand tool F must be used to press the electric wire E into position (see FIG. 2B). This complicated installation procedure tends to cause an installation error.

SUMMARY OF THE INVENTION

The present invention has been accomplished under the circumstances in view. It is one object of the present invention to provide an electric terminal device which can be conveniently assembled to make an electric contact with an electric wire without the use of any hand tools. It is another object of the present invention to provide an electric terminal device which provides a positive electric contact when assembled with an electric wire. According to the preferred embodiment of the present invention, the electric terminal device comprises a cap having two opposite wire holes and two opposite side openings at the four sides and two downward flanges on the inside, and a connecting terminal having horizontal ribs raised from the front and back sides and respectively engaged with the side openings on the cap and two elongated cutting slots and two connecting legs for welding to a circuit board, wherein when the cap is fastened to the connecting terminal after the electric wire is inserted through the wire holes, the downward flanges force the electric wires into the cutting slots of the connecting terminal, causing the connecting terminal to make an electric contact with the electric wire.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1B:
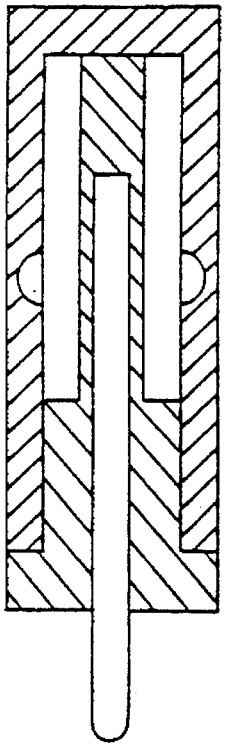
PRIOR ART FIG. 1B
FIG. 1B is a sectional view showing the cap and receptacle of FIG. 1A connected together.
Figure 1A:
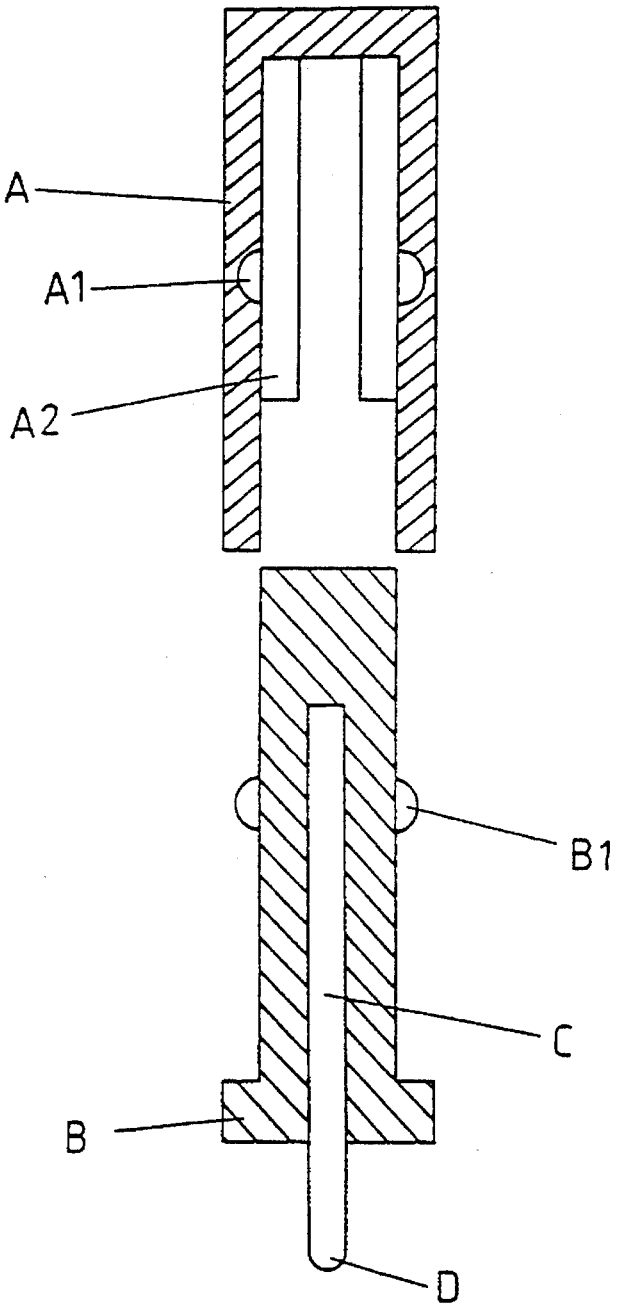
PRIOR ART FIG. 1A
FIG. 1A is an exploded view in section of an electric terminal device according to the prior art.
Figure 2A:
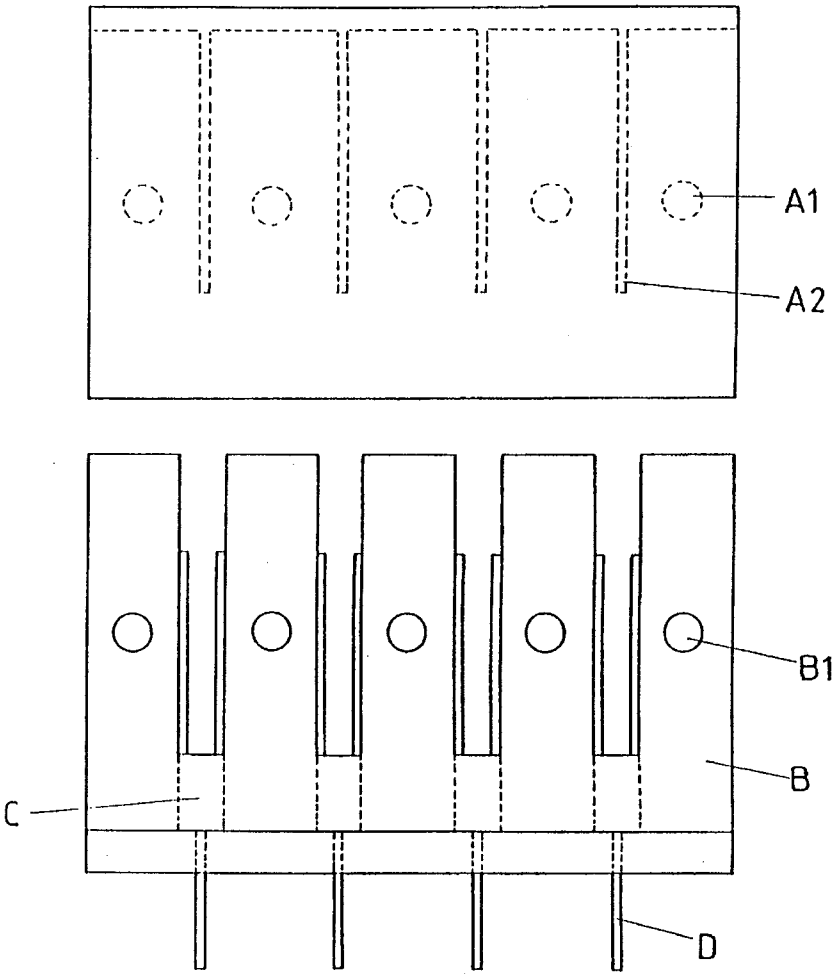
PRIOR ART FIG. 2A
FIG. 2A is an exploded plain view of a bar of electric terminals according to the prior art.
Figure 2B:
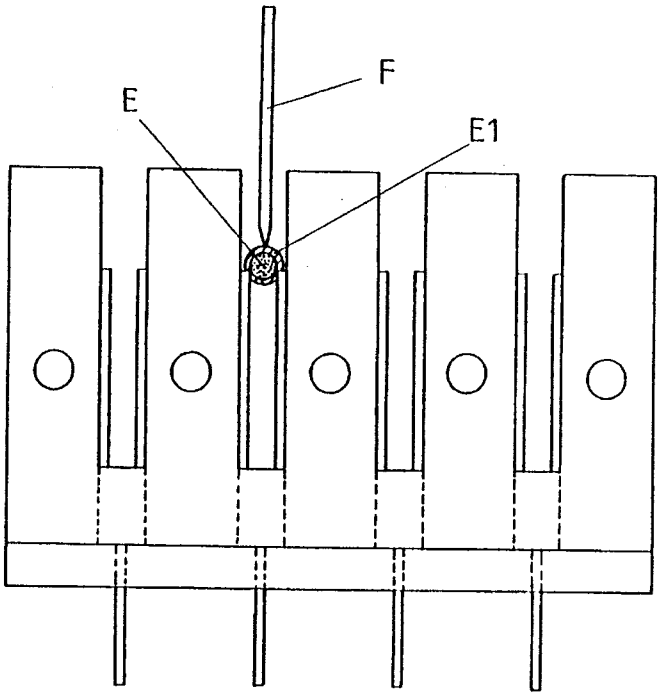
PRIOR ART FIG. 2B
FIG. 2B shows an electric wire fastened to the receptacles of the bar of electric terminal shown in FIG. 2A by a pointed hand tool.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 3:
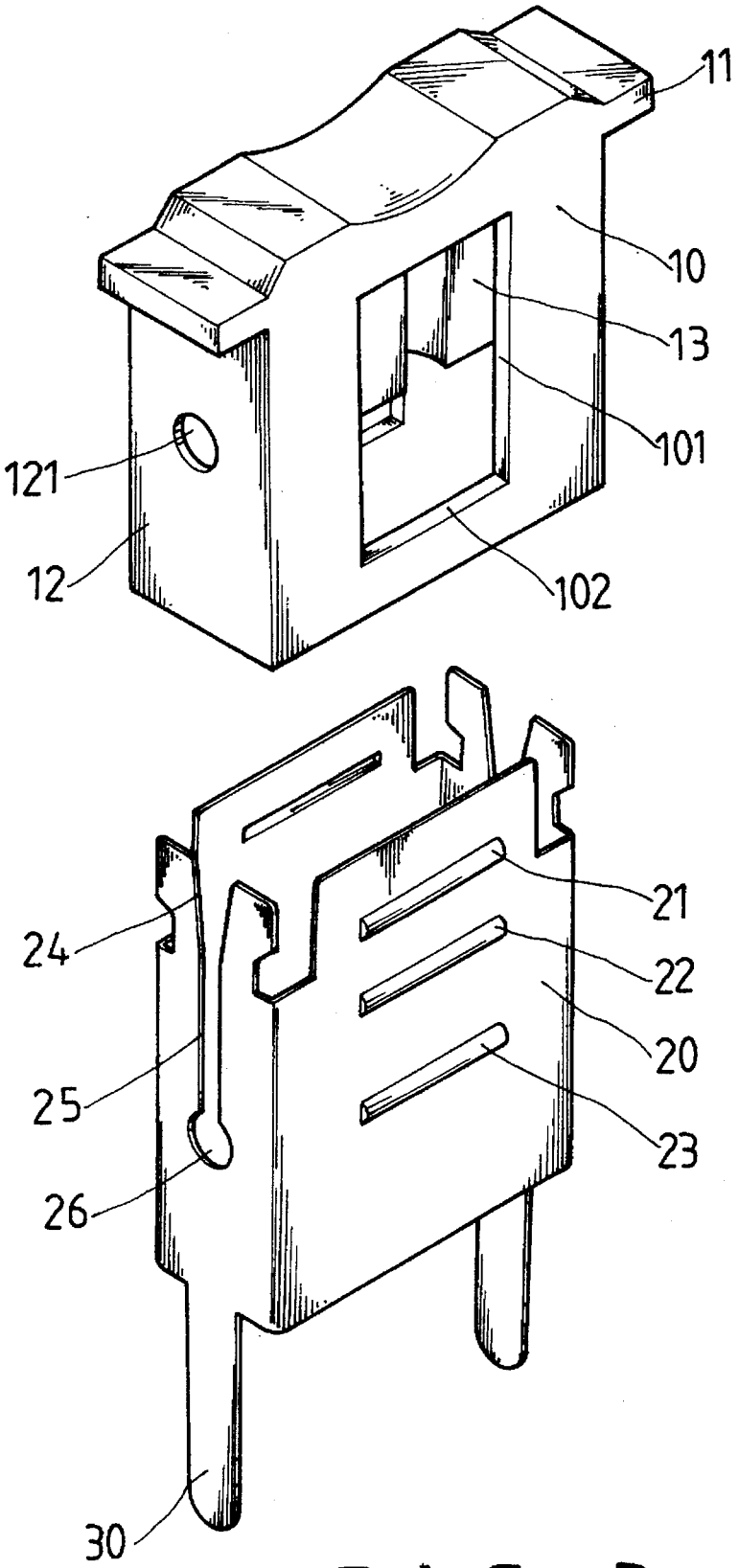
FIG. 3 is an exploded view of an electric terminal device according to the present invention.
Figure 4:
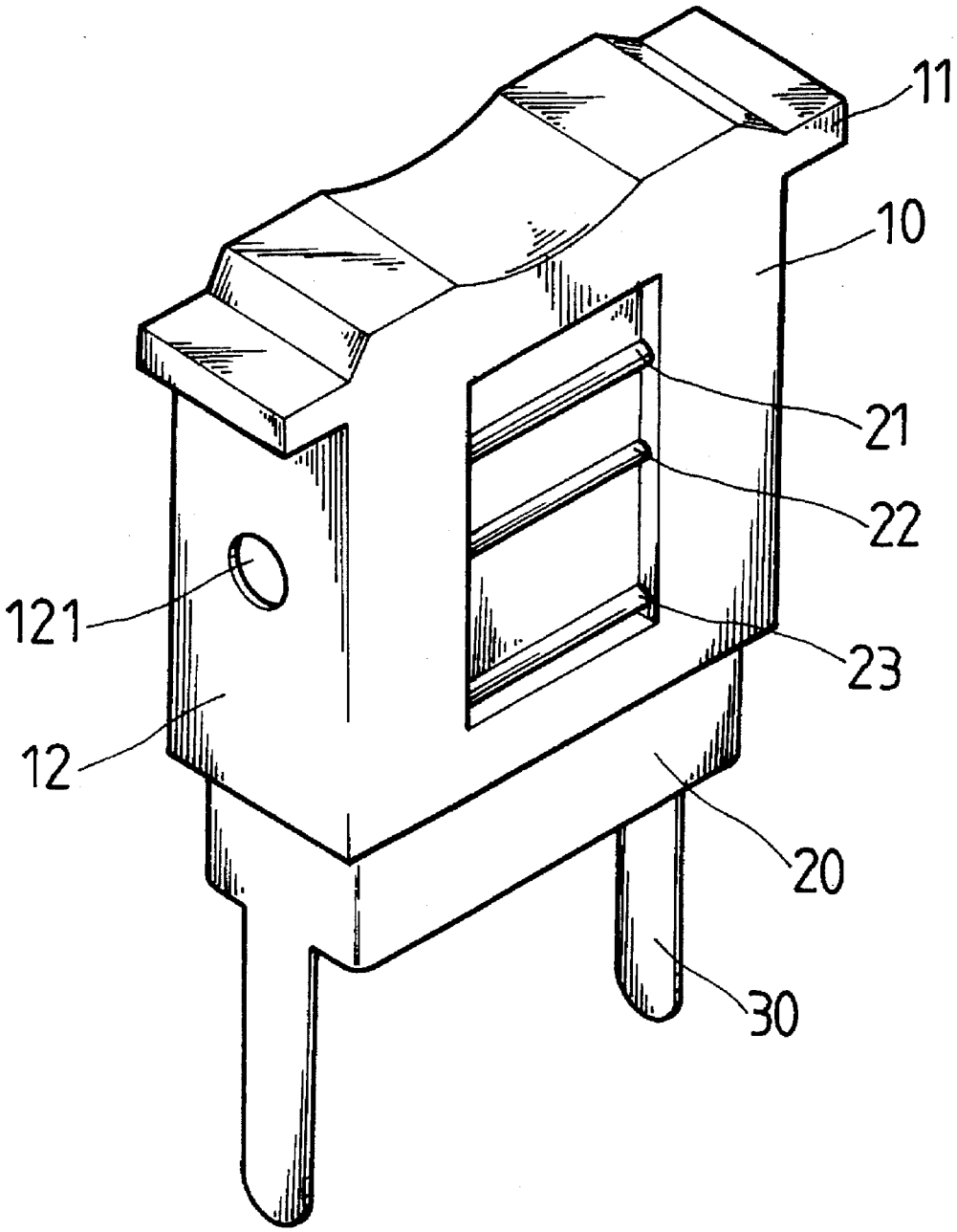
FIG. 4 shows the cap and connecting terminal of the electric terminal device of FIG. 3 connected together.
Figures 5A, 5B, 5C, 5D:
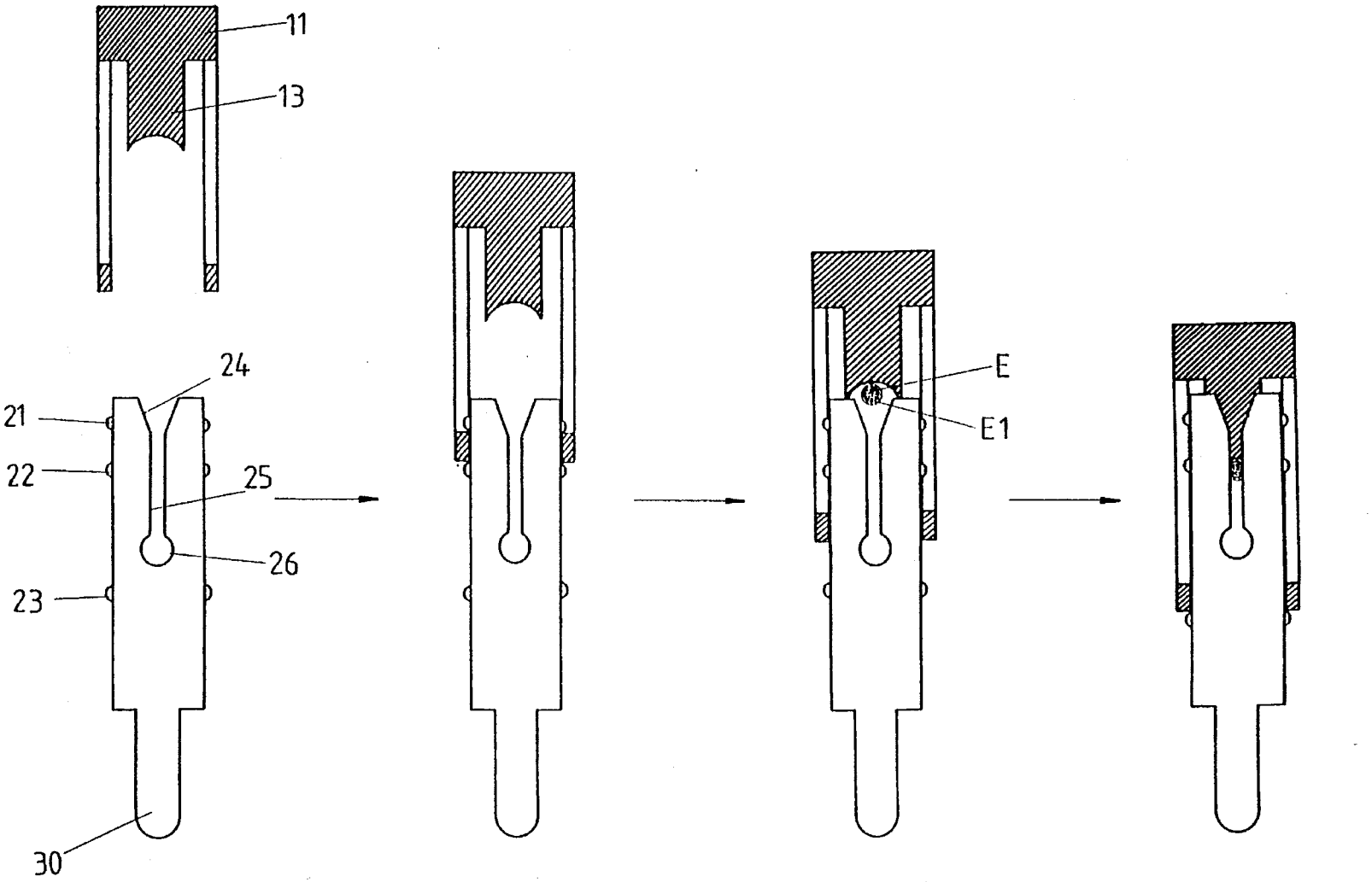
FIGS. 5A, 5B, 5C and 5D are a series of drawings showing the assembly process of the present invention to connect the electric terminal device to an electric wire.

Referring to FIGS. 3 and 4, an electric terminal device in accordance with the present invention is generally comprised of a cap 10 and a connecting terminal 20. The cap 10 is hollow rectangular covering formed of a rectangular top wall 14, two large side walls 15 and two small side walls 12 respectively perpendicularly extended from the four sides of the top wall 14 in the same direction defining with the top wall 14 a downward open chamber 16, having two outward flanges 11 horizontally extended from two opposite ends of the top wall 14 in reversed directions, two symmetrical openings 101 respectively made through the two opposite large side walls 15, two wire holes 121 respectively made through the two opposite small side walls 12, and two separate downward inside flanges 13 suspended in the downward open chamber 16 and extended from the top wall 14 to the elevation of the top side of the wire holes 121. The connecting terminal 20 is a rectangular open frame formed of two opposite small side walls and two opposite large side walls, having two connecting legs 30 down wards extended from the two opposite small side walls, two symmetrical sets of horizontal ribs respectively raised from the two opposite large side walls, each set of horizontal ribs including a first horizontal rib 21, a second horizontal rib 22, and a third horizontal rib 23, two elongated cutting slots 25 made through the two opposite small side walls and longitudinally respectively aligned with the connecting legs 30, each cutting slot 25 having a top end terminating in a top opening 24, whose width is made gradually bigger toward the top, and a bottom end terminating in a round hole 26 of diameter longer than the width of the elongated cutting slots 25. Furthermore, the horizontal ribs 21, 22, and 23 have a uniform length equal to the width of the openings 16 on the cap 10 and the distance between the first and third ribs 21 and 23 is approximately equal to the length of the openings 101 of the cap 10, therefore when the connecting terminal 20 is fitted into the cap 10, the horizontal ribs 21, 22, and 23 are forced into the openings 101, causing the connecting terminal 20 and the cap 10 firmly retained together.

The assembly process of the electric terminal device is outlined hereinafter with reference to FIGS. 5A, 5B, 5C and 5D. The connecting terminal 20 is inserted into the downward open chamber 16 of the cap 10, permitting the second horizontal ribs 22 to be extended out of the openings 101 and stopped at the bottom sides 102 of the openings 101, then the electric wire E is inserted through the wire holes 121 on the cap 10 and the top openings 24 on the two opposite small side walls of the connecting terminal 20, and then the cap 10 is forced down against the connecting terminal 20, permitting the third horizontal ribs 23 to be forced into the openings 101 to engage with the bottom sides 102 of the openings 101 respectively. Through the outward flanges 11, the cap 10 can be conveniently fastened to the connecting terminal 20 by hand. When the cap 10 is forced down against the connecting terminal 20, the electric wire E is simultaneously forced into the elongated cutting slots 25 by the downward flanges 13 of the cap 10, causing the opposite sharp edges of the cutting slots 25 pierced the insulator E1 of the electric wire E to make an electric contact. During the assembly process, the round holes 26 disperses the outward pressure transmitted from the electric wire E to the elongated cutting slots 25.

Figure 6:
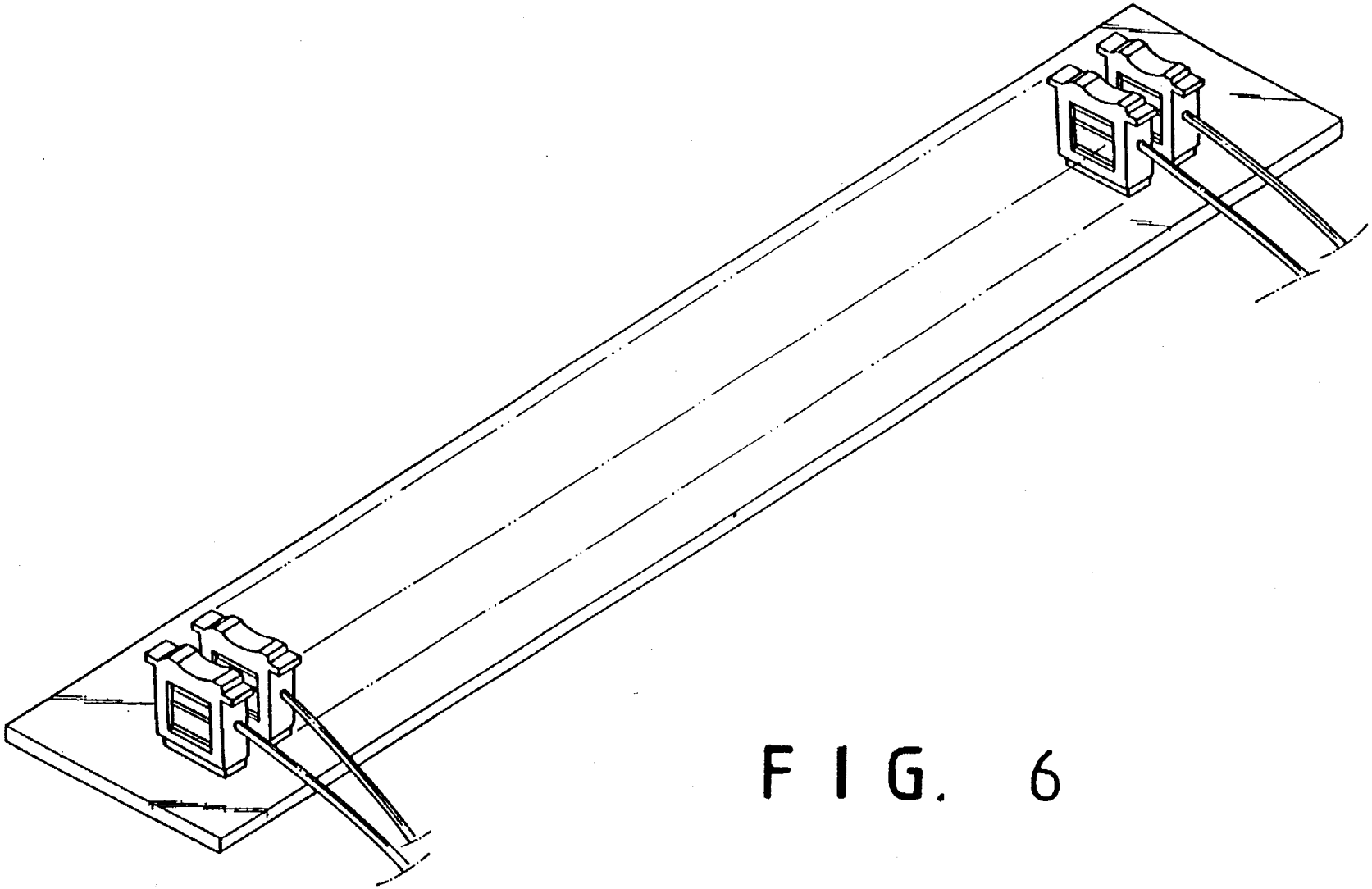
FIG. 6 shows an example of application of the present invention to form an I/O bus bar.

FIG. 6 shows an application of the present invention, in which a plurality of electric terminal devices are welded to a circuit board to form an I/O bus bar. By means of the connecting legs 30 (see FIG. 3), the electric terminal device of the present invention can be conveniently welded to a circuit board.

Figure 7:
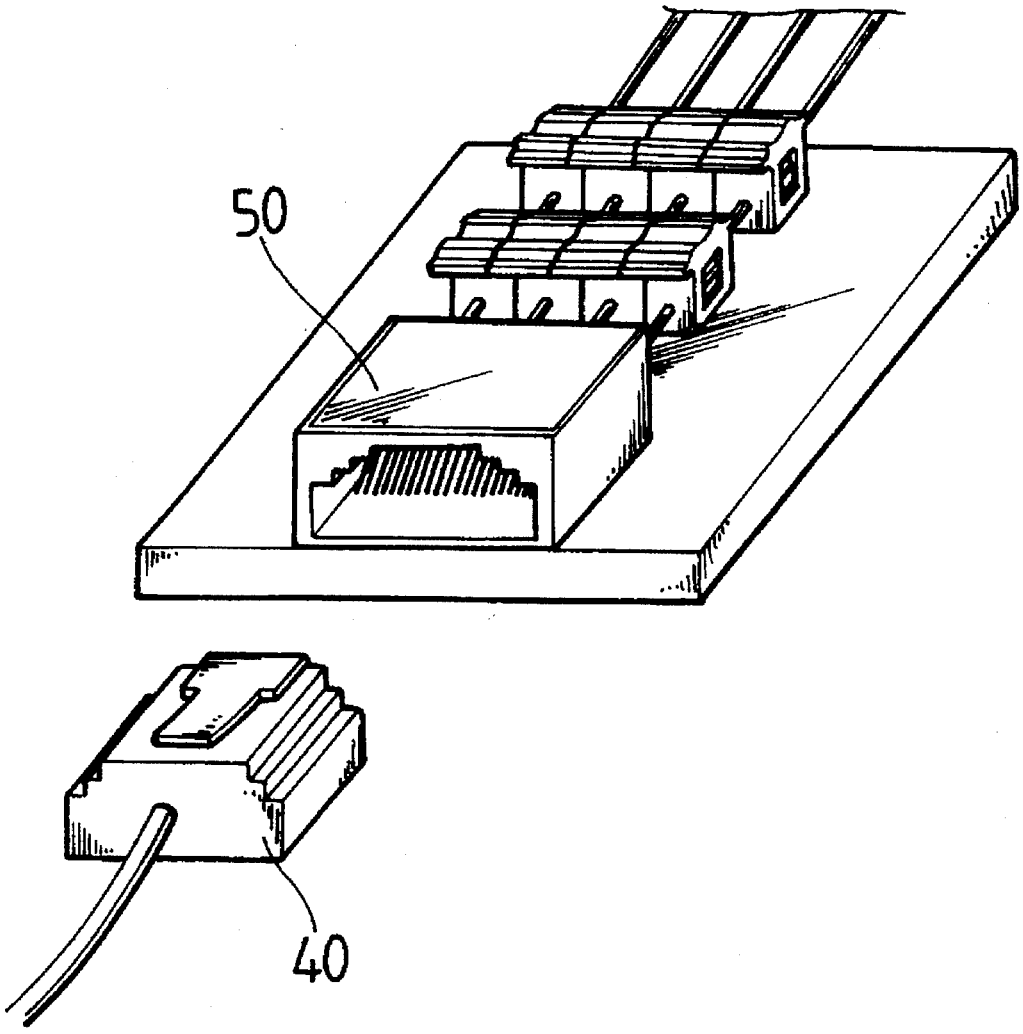
FIG. 7 shows another example of application of the present invention, incorporated with a module jack for the connection of a module plug.

FIG. 7 shows another application of the present invention, in which a plurality of electric terminal devices are welded to a circuit board and connected to a module jack 50 for the connection of a module plug 40.

While only one embodiment of the present invention has been shown and described, it will be understood that various modifications and changes could be made without departing from the spirit and scope of the invention.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An electric terminal device comprising:

a cap having a rectangular top wall having two long sides and two short sides, two large side walls and two small side walls respectively perpendicularly extended from the four sides of said rectangular top wall in the same direction defining with said top wall a downward open chamber, two outward flanges horizontally extended from the two short sides of said rectangular top wall in reversed directions for gripping by a user, two symmetrical retaining openings respectively made through the two opposite large side walls of said cap, and two wire holes respectively made through the two opposite small side walls of said cap, and two separate downward inside flanges suspended in said downward open chamber;

a connecting terminal made from a rectangular open frame formed of two opposite small side walls and two opposite large side walls, said connecting terminal having two connecting legs down wards extended from the two opposite small side walls of said connecting terminal for welding to a circuit board, two sets of horizontal ribs of equal length respectively raised from the two opposite large side walls of said connecting terminal at different elevations and engaged into the openings on the two opposite large side walls of said cap, two elongated cutting slots made through the two opposite small side walls of said connecting terminal and longitudinally respectively aligned with said connecting legs, each cutting slot having a top end terminating in a broad top opening and a bottom end terminating in a round hole of diameter longer than the width of said elongated cutting slots, and wherein when an electric wire is inserted through said wire holes on the cap, said connecting terminal is fitted into the downward open chamber of said cap to force said horizontal ribs into engagement with the openings on the two opposite large side walls of said cap, causing said electric wire to be forced by said downward flanges of said cap into said elongated cutting slots through the broad top openings of said elongated cutting slots to make an electric contact with said connecting terminal.

* * * * *